US006827099B2

(12) United States Patent
Tanaka et al.

(10) Patent No.: US 6,827,099 B2
(45) Date of Patent: Dec. 7, 2004

(54) SEALING METHOD AND APPARATUS FOR FLUID CONTAINER

(75) Inventors: Yasusumi Tanaka, Kawasaki (JP); Katsutoshi Yoshifusa, Takasaki (JP)

(73) Assignee: Air-Paq, Inc., Lake Forest, CA (US)

( * ) Notice: Subject to any disclaimer, the term of this patent is extended or adjusted under 35 U.S.C. 154(b) by 0 days.

(21) Appl. No.: 10/458,395

(22) Filed: Jun. 10, 2003

(65) Prior Publication Data

US 2004/0035463 A1 Feb. 26, 2004

(51) Int. Cl.[7] ..... B65D 30/24; F16K 15/16

(52) U.S. Cl. ..... 137/255; 137/843; 383/44; 156/290

(58) Field of Search ..... 137/843, 846, 137/255; 383/44, 48, 50, 57; 156/290

(56) References Cited

U.S. PATENT DOCUMENTS 4,708,167 A 11/1987 Koyanagi
4,850,912 A 7/1989 Koyanagi
5,209,264 A 5/1993 Koyanagi
5,308,163 A 5/1994 Abe
5,388,910 A 2/1995 Koyanagi
5,460,200 A 10/1995 Glicksman
5,469,966 A * 11/1995 Boyer ..... 383/44
5,540,500 A 7/1996 Tanaka
5,564,143 A * 10/1996 Pekar et al. ..... 137/846
5,927,336 A 7/1999 Tanaka et al.

* cited by examiner

*Primary Examiner*—Kevin Lee
(74) *Attorney, Agent, or Firm*—Muramatsu & Associates

(57) ABSTRACT

A method and apparatus for a fluid container having a plurality of container members and firmly sealing the fluid container to prevent reverse flows of fluid from the container members where each container member is not provided with a check valve. The fluid container includes a guide passage, a plurality of container members, and narrow passages connecting the guide passage and the container members, and a check-valve formed at an input of the guide passage for allowing a fluid flow of only one predetermined direction. A fluid is introduced through the input of the guide passage, the check-valve, and the narrow passages to the container members, thereby inflating the container members. The narrow passages are sealed after the inflation of the container members.

20 Claims, 7 Drawing Sheets

SEALING METHOD AND APPARATUS FOR FLUID CONTAINER

FIELD OF THE INVENTION

This invention relates to a fluid container having a plurality of container members as packing material, and more particularly, to a method and apparatus which is capable of easily inflating the fluid container and firmly sealing the fluid container to prevent reverse flows of fluid from the plurality of separate container members where each container member is not provided with a check valve.

BACKGROUND OF THE INVENTION

Styroform boxes and frames have long been used as a material for packing commodity products such a TV, VCR, washing machine, refrigerator, computer, wine bottle, etc. or industrial products such as electrical parts, mechanical parts, etc. Although the styroform has a merit such as a good thermal insulation performance and light weight, it has also various demerits. For example, recycling is not possible, a large amount of soot is produced when it is burnt, flakes or chips fall off when it gets snagged because of its brittleness, an expensive mold is needed to produce it, and a large storage space such as a warehouse is necessary to store it.

Therefore, to solve such problems noted above, a new packing method using a fluid container is recently proposed. The fluid container inflates by sealingly containing fluid such as liquid or gas therein. The fluid container has better characteristics which can solve the problems involved in the styroform. First, because the fluid container is made of only thin sheets, it does not need a special warehouse to store it unless the container is inflated. In other words, a large number of fluid containers can be transported by a small cargo stocked in a small space. Secondly, the mold is not necessary because of its simple structure, i.e., two dimensional structure by the thin sheets. Thirdly, the fluid container does not produce chips, flakes or dust that would have an adverse effect on precision products or environment. Also, material that can be recycled can be used as thermoplastic films of the fluid container. Further, because of the advantages noted above, the fluid container can be produced with a lesser cost than that of the styroform packing.

FIG. 1 is a perspective view showing an example of structure of the fluid container in the conventional technology. The container of FIG. 1 is composed of first and second thermoplastic container films 13 and 14, and a check valve 11. Typically, each thermoplastic film is composed of three layers: for example, polyethylene, nylon and polyethylene layers which are bonded together with appropriate adhesive. The first and second thermoplastic containers are heat-sealed together around a rectangular periphery except where an inlet port is formed. Thus, one container bag is formed by sealing the edges at the bonding portion 12 such as shown in FIG. 1.

In FIG. 1, the check valve 11 is typically made of two rectangular thermoplastic valve films which are bonded together to form a fluid pipe. The fluid pipe has a tip opening and a valve body to allow the fluid such as air flowing through the fluid pipe from the tip opening but the valve body disallows the reverse flow of the fluid. More details of an example of structure and performance of the check valve are disclosed in the U.S. Pat. Nos. 5,209,264, 4,708,167 and 5,927,336.

FIGS. 2A–2B show an example of a fluid container with a plurality of container members (small bags) each having a check valve. A main purpose of having a plurality of container members is to increase the reliability as well as to limit the thickness of the fluid container when it is inflated. Even if one of the container members causes an air leakage for some reason, the fluid container can still function as a cushion of package because other container members work properly. In order to achieve this purpose, each container member has to independently maintain its inflated state from the other.

Referring to FIG. 2A, the fluid container is made of first and second thermoplastic container films (FIG. 1) which are bonded together around a rectangular periphery and further bonded together at a boundary of each container member (bonded portion 12) so that a guide tube 21 and a plurality of elongated container members 22 are created. When the first and second thermoplastic container films are bonded together at the bonded portions 12, as shown by the hatching in FIG. 2A, a check-valve 11 is also embedded in each inlet port of each container member 22 to make each container member independent. The inlet port 24 of the fluid container is used when filling a fluid, typically air, to each elongated container member 22 from an air compressor and the like.

FIG. 2B shows an example of fluid container with a plurality of elongated container members each having a check valve. The fluid container of FIG. 2B is inflated by filling the fluid. First, each elongated container member 22 is filled with the fluid such as air from the inlet port 24 through the guide tube 21 and each check valve 11. Considering variations in environmental temperature, filling the fluid is typically stopped when the container member is inflated at about 90% of its full inflation rate. After filling the fluid, the inflation of each member is maintained because each check valve 11 of the container member prevents the reverse flow. Typically, the fluid supplier, such as an air compressor has a gage to always monitor the supplied fluid (air) pressure, and automatically stops supplying the air to the inlet port 24 of the fluid container when the pressure reaches a predetermined value.

As described in the foregoing, the fluid container using check valves is suitable for packing a product and is advantageous over the styroform. Thus, it can be used as a package material for any commodity or industrial products. Because the size of the fluid container is very small if the fluid is not filled in, it is easy to transport and it does not need a large space such as a warehouse to store it. The fluid container has a further advantage of its flexibility, for example, by gradually filling the fluid, it can become any shape needed to match a gap shape between a product and a package frame. In general, the overall cost of the fluid container is lower than that of the styroform because of the less cost for transportation and/or storage. However, as for the fluid container with multiple container members each having a check valve, the cost of the check valves accounts a high percentage of the total cost of the fluid container. Therefore, there is a need to reduce the cost of the check valves in the fluid container.

SUMMARY OF THE INVENTION

It is, therefore, an object of the present invention to provide a new structure of a fluid container having a plurality of small container members which can significantly reduce the overall cost.

It is another object of the present invention to provide a fluid container having a plurality of small air bags where the small air bags are air-tightly sealed without using check valves, thereby reducing the cost.

It is a further object of the present invention to provide a method and apparatus for easily and effectively sealing a plurality of container members of the fluid container after filling the fluid therein.

It is a further object of the present invention to provide a fluid container which can be repeatedly used by easily removing the clamp member and releasing the fluid from the fluid container.

It is a further object of the present invention to provide a heat-sealing method to prevent the reverse flow from each container member.

More specifically, the fluid container for sealingly containing a fluid of the present invention is comprised of: first and second thermoplastic container films juxtaposed with each other where predetermined portions of the first and second thermoplastic container films are bonded, thereby creating a guide passage, a plurality of container members, and narrow passages connecting the guide passage and the container members; and a check-valve formed at an input of the guide passage for allowing a fluid flow of only one predetermined direction. A fluid is introduced through the input of the guide passage, the check-valve, and the narrow passages to the container members, thereby inflating the container members. The narrow passages are sealed after the inflation of the container members.

In one embodiment, the narrow passages are sealed by a clamp member having a set of a clamp rod and a receptacle made of flexible material, and the clamp member clamps the narrow passages between the receptacle and the clamp rod by positioning the narrow passages on the receptacle and pressing the clamp rod in the receptacle. The clamp rod has an outer diameter which is substantially the same or smaller than an inner diameter of the receptacle, and the receptacle has an opening which is slightly smaller than the outer diameter of the clamp rod, thereby locking the clamp rod when the clamp rod is pressed in the receptacle.

In another embodiment, the narrow passages are sealed by a clamp member having two sets of a clamp rod and a receptacle made of flexible material, and the clamp member clamps the narrow passages between the receptacles and the clamp rods by positioning the narrow passages on the receptacles and pressing the clamp rods in the receptacles. In each set of the clamp rod and receptacle, the clamp rod has an outer diameter which is substantially the same or smaller than an inner diameter of the receptacle, and the receptacle has an opening which is slightly smaller than the outer diameter of the corresponding clamp rod, thereby locking the clamp rod when the clamp rod is pressed in the receptacle. The clamp member further includes a bulge between the two receptacles. The bulge is protruded in a direction opposite to an inner projection of each receptacle, thereby increasing an sealing effect when the clamp rods are pressed in the corresponding receptacles.

Another aspect of the present invention is a method of producing a fluid container which is comprised of the steps of: providing first and second thermoplastic container films juxtaposed with each other; bonding the predetermined portions of the first and second thermoplastic container films, thereby creating a guide passage, a plurality of container members, and narrow passages connecting the guide passage and the container members; forming a check-valve between the first and second thermoplastic container films at an inlet of the fluid container: and inflating the plurality of container members by introducing a fluid through the guide passage, the check-valve, and the narrow passages to the container members; and air-tightly sealing the narrow passages after the inflation of the container members.

According to the present invention, the sealing method and apparatus of the present invention enables a user to quickly inflate the fluid container and easily make each container element independent from one another by clamping or heat-sealing the narrow passages connected to the corresponding container members. If the clamping member is used, the fluid container can be used repeatedly. Further, as a result of reducing the number of check-valves used in the fluid container, the cost for producing the container is substantially reduced. If the heat sealing method is used, the single check valve makes the process easy although the container itself is non-reusable. This feature is also effective in reducing the total production cost of the container.

DETAILED DESCRIPTION OF THE INVENTION

The present invention is described in detail with reference to the accompanying drawings. The fluid container in the present invention is designed to reduce the production cost by eliminating the check valve for each container member and providing a clamping member of simple structure. Thus, no check valve is used for the input of each container member. Only one check valve is incorporated at an input of the fluid container for introducing the fluid, typically an air, therethrough.

The fluid container of the present invention is also designed to be used repeatedly by easily releasing the fluid. Typically, the fluid container having multiple container members in conventional technologies can not be reusable. This is because, for squeezing the air out from the container members, all the check-valves used in the fluid container have to be disabled to release the fluid by the reverse flow. However, the check-valves 11 of the container members are not easily accessible for a user to disable them. Accordingly, using the fluid container having multiple container members with check valves is limited only once. In contrast, the fluid container with use of a clamp member in the present invention is usable a number of times.

Figure 1:
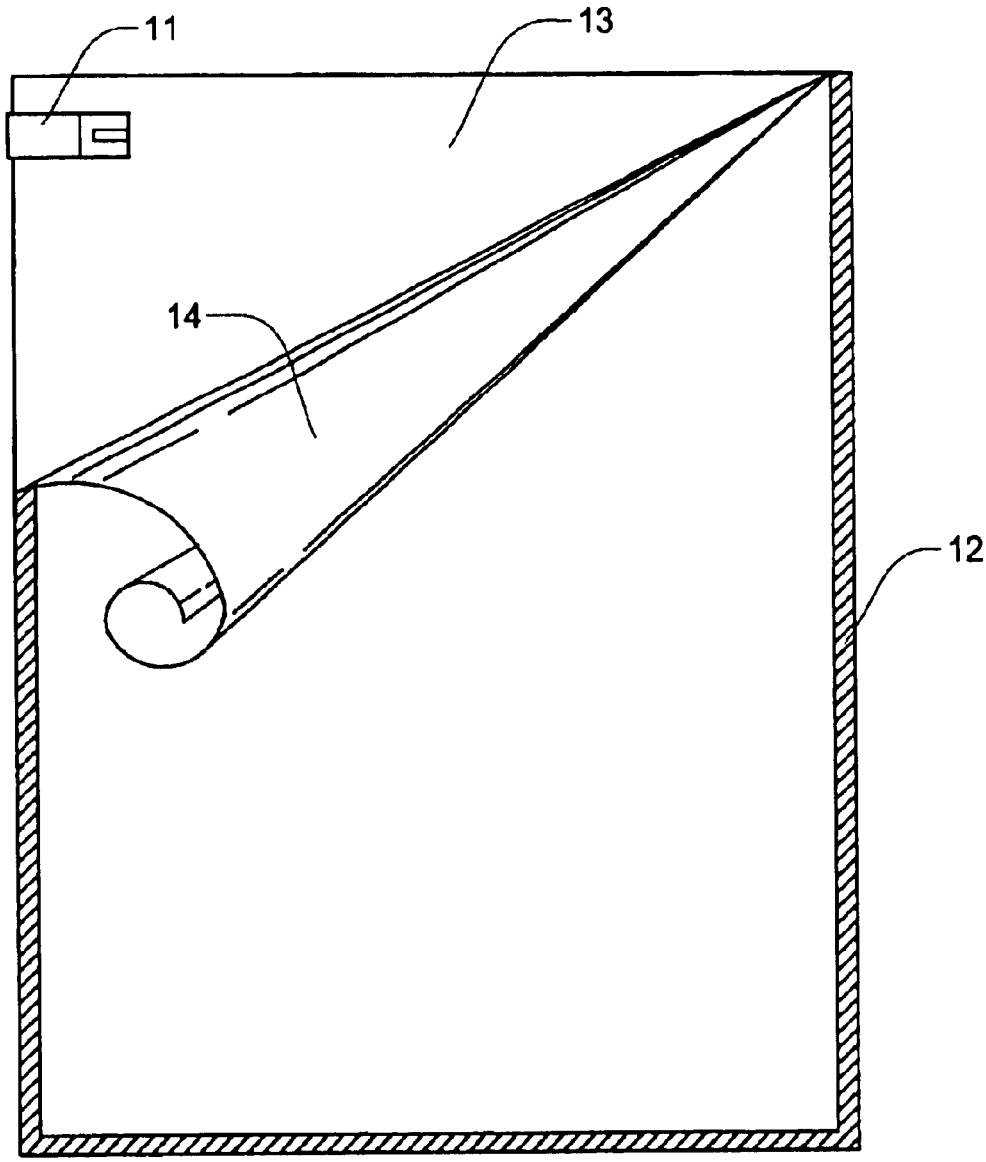
Fig. 1 (Prior Art)
FIG. 1 is a schematic diagram showing an example of outer appearance of a typical fluid container in the conventional technology.
Figure 2A:
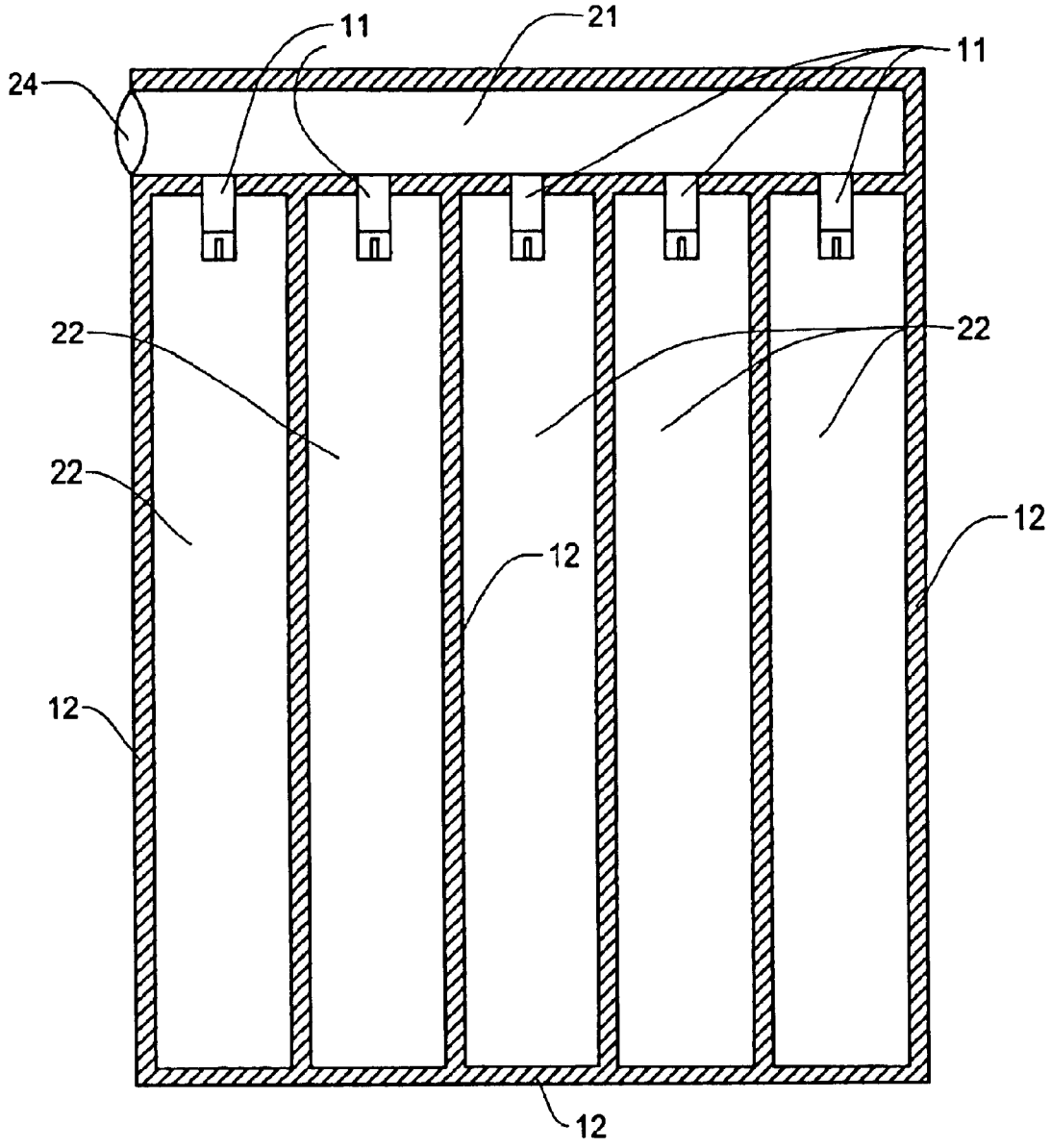
Fig. 2A (Prior Art)
FIGS. 2A–2B are schematic diagrams showing a structure of a fluid container in the conventional technology which has multiple container members each having a check-valve for preventing a reverse flow of fluid.
Figure 2B:
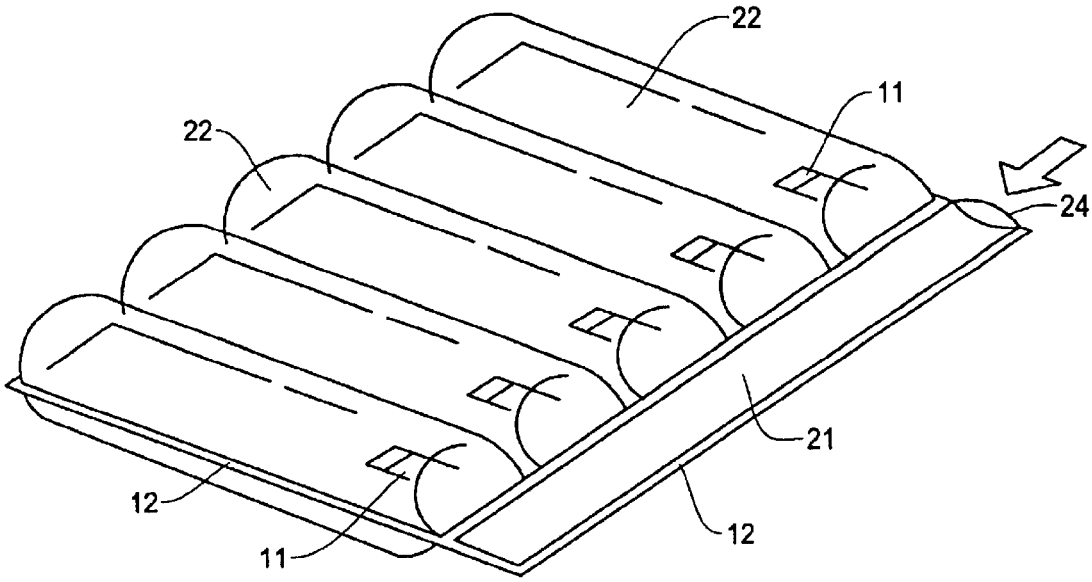
Fig. 2B (Prior Art)
Figure 3A:
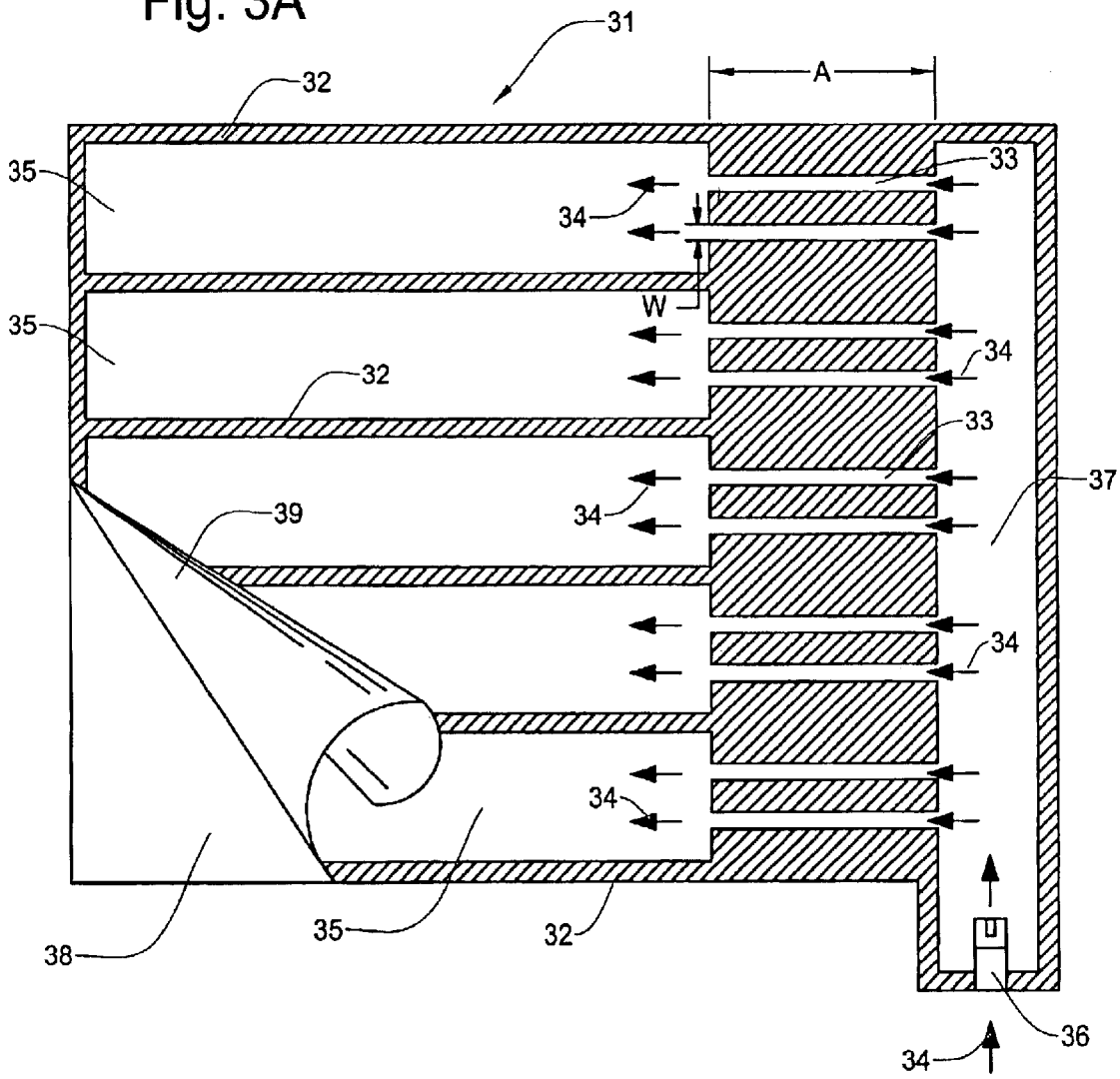
FIGS. 3A–3B are schematic diagrams showing an example of structure of a fluid container having multiple container members in accordance with the present invention where each container member is not provided with a check valve.
Figure 3B:
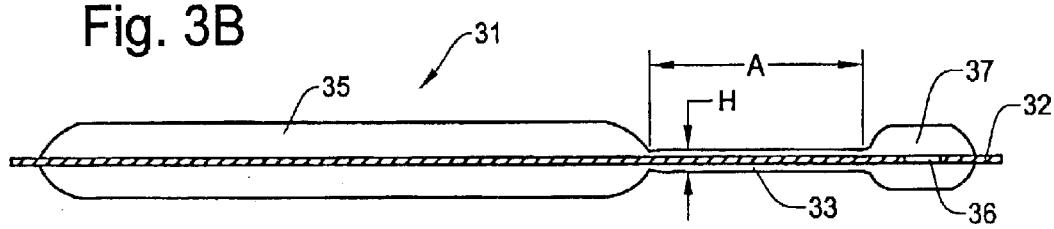

FIGS. 3A–3B show an example of fluid container in the present invention. With reference to FIG. 3A, a fluid container 31 is comprised of first and second thermoplastic container films 38–39 juxtaposed with each other. The first and second thermoplastic container films 38–39 are bonded around a rectangular periphery thereof and other inside portions as shown by the hatching (hereafter "bonded portions 32"). Accordingly, a plurality of elongated container members (small air bags) 35, a guide passage 37, and narrow passages 33 connecting the guide passage 37 and the container members 35 are formed by the bonded portions 32. A check valve 36 is formed at an input area of the guide passage 37.

Each of the thermoplastic container films 38 and 39 is made of, for example, three layers of material; polyethylene, nylon and polyethylene to achieve sufficient flexibility and strength. As seen in the drawings, only one check valve 36 is used in the fluid container 31 although the container has many small container members 35. In this example, an overall shape of the fluid container 31 is rectangular. However, the shape of the fluid container of the present invention is not limited to such a particular shape but can be any other shape that can perform a packing function.

To introduce the fluid independently to each container member 35, the fluid container 31 of the present invention includes the narrow passage 33. The narrow passages 33 is relatively long as indicated by a reference label A of FIG. 3A to which a clamp member is applied after filling the fluid (such as air) to prevent the reverse flows through the narrow passages 33. Further, each of the narrow passages 33 has a small inner diameter so that the outer thickness H (FIG. 3B) of this portion is for example, 1–2 mm, when the fluid container is inflated. Because of such a relatively small thickness and large length, the portion of the narrow passages 33 is folded and is clamped by the clamp member as will be described in detail later.

FIG. 3B shows an example of cross sectional view when the fluid container 31 of the present invention is inflated by supplying a fluid therein. Typically, the fluid is air which is provided from, for example, an air compressor. Arrows 34 show the flow of the air from the inlet, narrow passages 33 and to the container members 35. At the input of the fluid container 31, the compressed air flows through the check valve 36 toward the container members 35. Because of the check valve 36, the air supplied to the fluid container 31 will not flow back to the outside.

Each container member (small air bag) 35 is typically inflated up to about 90% of its full inflation rate in consideration of increase in the environmental temperature. In general, the air compressor (not shown) has a gage to monitor the pressure of the air and automatically stops supplying the air to the fluid container 31 when the pressure reaches a predetermined value. Then, the supplied pressure is maintained in the fluid container 31 because the check-valve 36 prevents the reverse flow. However, at this moment, the air in each container member 35 is not independent from the other because they are connected through the narrowed passages 33.

Figure 4A:
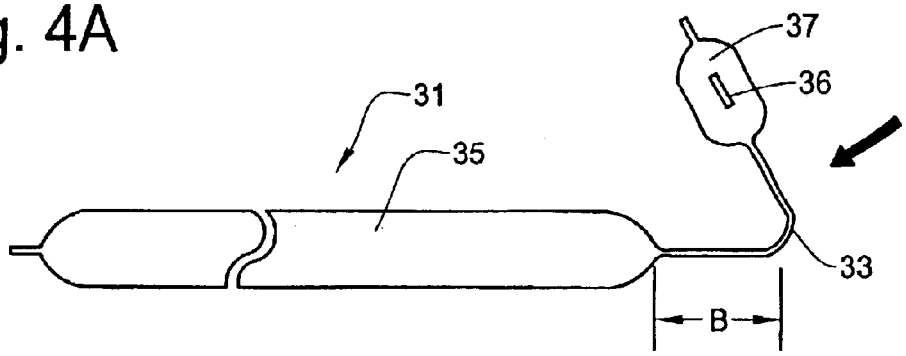
FIGS. 4A–4C are schematic diagrams showing an example of clamping method to air-tightly seal the multiple container members by folding and clamping the narrow fluid passages of the fluid container.
Figure 4B:
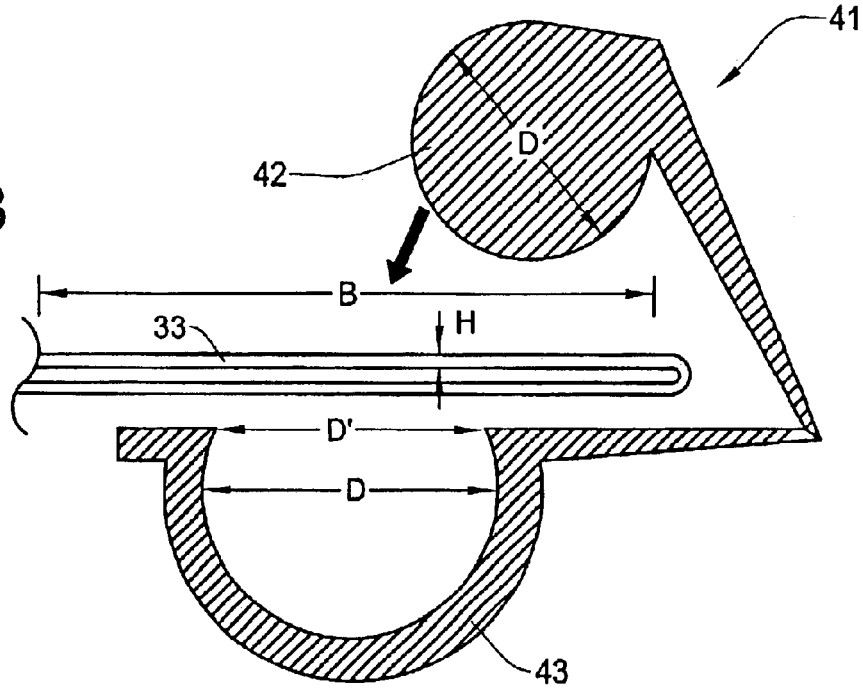
Figure 4C:
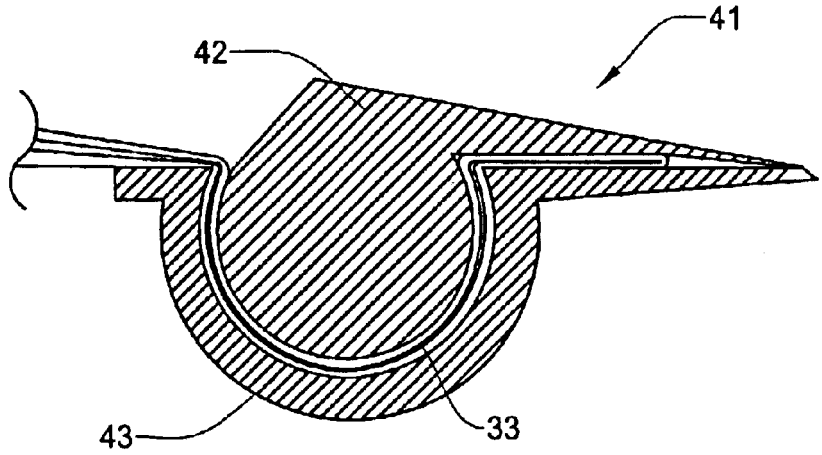

To air-tightly seal the fluid container 31 in a manner that each container member 33 becomes independent from one another, the reverse flow in the narrow passages 33 of the length A has to prevented. FIGS. 4A–4C show an example of structure and method in one of the preferred embodiments to air-tightly seal the narrow passages 33 to prevent the reverse flow. In this example, the portion of the narrow passages 33 is folded in two and a folded part B is clamped by the clamp member of the present invention.

FIG. 4A is a cross-section view showing how the narrow passages 33 between the container members 35 and the guide passage 37 are folded. After supplying the compressed air in the fluid container 31, this folding operation is conducted manually or by a machine operation. After the narrow passages 33 are folded, the folded portion B as shown in FIG. 4A is clamped by a clamp member to seal the fluid container 31.

FIGS. 4B–4C are enlarged cross-section views showing how the clamping operation is implemented. To clamp the folded portion B, a clamp member 41 having a set of a receptacle 43 and a clamp rod 42 having a circular cross section is used such as shown in FIG. 4B. The folded portion B is fastened by the clamp member 41 when the clamp rod 42 is fit in the receptacle. In order to clamp the narrow passages 33 firmly, the thickness H of the narrow passages 33 has to be small such as 1–2 mm as noted above. Otherwise, it is not easy to fasten the clamp member 41 while the folded portion B is between the receptacle 43 and the clamp rod 42, requiring a larger pressure to fit in the clamp rod 42.

As shown in FIG. 4B, the clamp rod 42 has an outer diameter D and the receptacle 43 has an inner diameter D or slightly larger than D. To lock the clamp rod 42 by sufficiently fitting in the receptacle 43, the upper opening D' of the receptacle 43 is preferably slightly smaller than the diameter D of the clamp rod 42. Preferably, the receptacle and the clamp rod of the clamp member 41 are integrally formed although it is also possible that they can be separately prepared.

FIG. 4C shows the condition where the clamping operation for the folded portion B is conducted. The clamp member 41 is made of, for example, plastic that is appropriately rigid and flexible. Thus, when the clamp rod 42 is pressed in the receptacle 43 when the folded portion B is in-between, the opening of the receptacle 43 is widened. Once the clamp rod 42 is fit in the receptacle, the opening is returned (i.e., slightly closed) so that the clamp rod 42 is locked in the receptacle 43. If necessary, the clamp rod 42 is removed from the receptacle 43 by manually taken out therefrom.

As described in the first preferred embodiment shown in FIGS. 4A–4C, an appropriate inflation state of each container member is maintained independently by the folding and clamping operations for the narrow passages 33. It should be also noted that the fluid container 31 can be reusable if the clamp member 41 is taken out and, if necessary, the air is released from the container members 35 by the reverse flow of the air through the check-valve 36. For a typical check-valve, the reverse flow is allowed by inserting a piece of straw (pin) into the inlet of the check-valve. By emptying the air in this manner, the fluid container 31 returns to the original shape, i.e., a flat sheet, thus, it is easy to stock a large amount of fluid containers in a small space or to transport a large number of fluid containers by a small carrier.

Figure 5A:
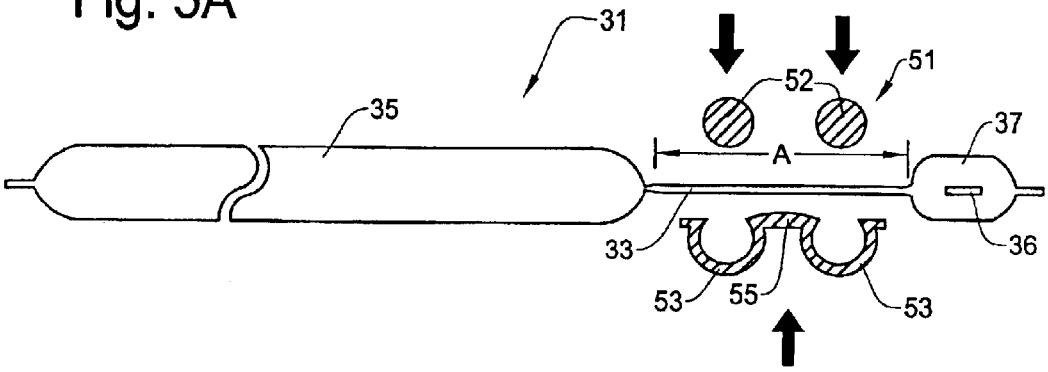
FIGS. 5A–5B are schematic diagrams showing another example of clamping method to air-tightly seal the multiple container members by folding and clamping the narrow fluid passages of the fluid container.
Figure 5B:
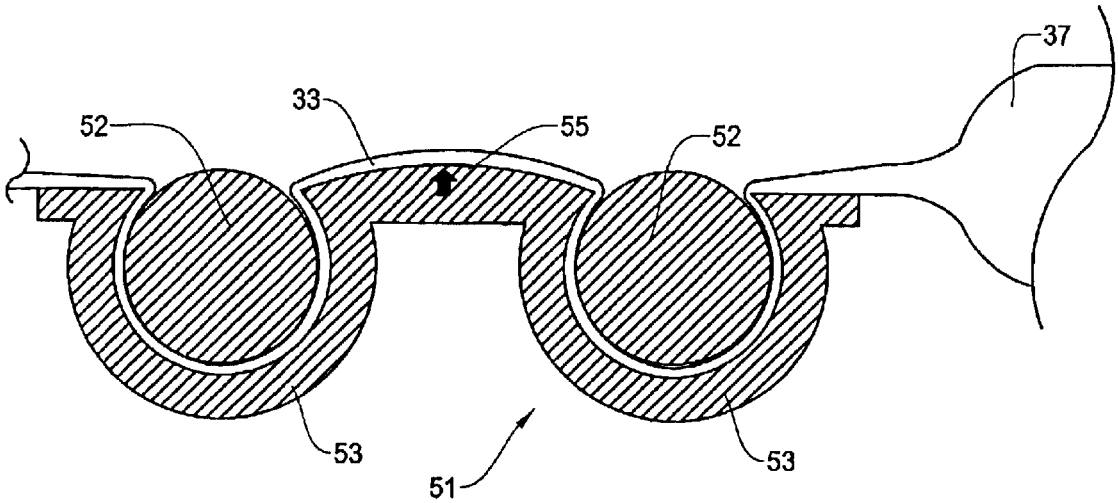

A second preferred embodiment of the present invention is shown in FIGS. 5A–5B. In this example, a clamp member 51 has a pair of clamp rods 52 and a pair of receptacles 53. In other words, the clamp member 51 of FIGS. 5A–5B is like having two sets of clamp member 41 of FIGS. 4A–4C. An intermediate portion of the receptacles 53 is bulged or protruded in a small degree (hereafter "bulge 55") as better shown in FIG. 5B. In this embodiment, without folding, the narrow passages 33 is clamped by the clamp member 51.

FIG. 5A is a cross-section view of the fluid container 31 showing the narrow passages 33 which are clamped by the clamp member 51 having two sets of clamp rods 52 and the receptacle 53. Because of the two clamping actions, a higher sealing effect is achieved. The size and shape of clamp rod and receptacle are basically the same as that of FIGS. 4A–4C. It is so designed that the length A of the narrow passages 33 is sufficiently longer than the clamp member 51. After inflating the fluid container 31, the clamp member 51 is brought so that the two receptacles 53 are positioned under the narrow passages 33. In this situation, the narrow passages 33 are placed over the receptacles 53 where the bulge 55 is located at around the center. The clamp rods 52 are placed over the corresponding receptacles 53. The clamping operation for the two sets of the clamp rods 52 and receptacles 53 is performed either manually or by a machine operation.

FIG. 5B is an enlarged cross-section view showing the condition that the clamping operation for the narrow passages 33 is conducted. Since the diameter of the clamp rod 52 is designed to be fit in the corresponding receptacle 53, when pressed in the receptacle 53 while the narrow passages 33 therebetween, the clamp rod 52 is locked because the opening of the receptacle is smaller than the diameter of the clamp rod 51. Thus, the fluid container 31 is air-tightly sealed by the clamp member 51. When the clamp member 51 is attached in this manner, the bulge 55 promotes the sealing because its protrusion in the upper direction of FIG. 5B is opposite to that of the clamp rod 51 in the receptacle 53, i.e., an inner projection of the receptacle 53, thereby clamping the narrow passages 33 harder. Thus, the sealing effect is further increased by the bulge 55.

As described in the foregoing, in the second embodiment shown in FIGS. 5A–5B, the appropriate inflation of each container member is maintained independently by clamping the narrow passages 33 using the two sets of clamp rods and receptacles. It should be noted that, like the first embodiment, the fluid container 31 is reusable if the clamp member 51 with two sets of the clamp rods and receptacles is removed and the reverse flow of the check-valve 36 at the inlet port is allowed to exhaust the air.

Figure 6A:
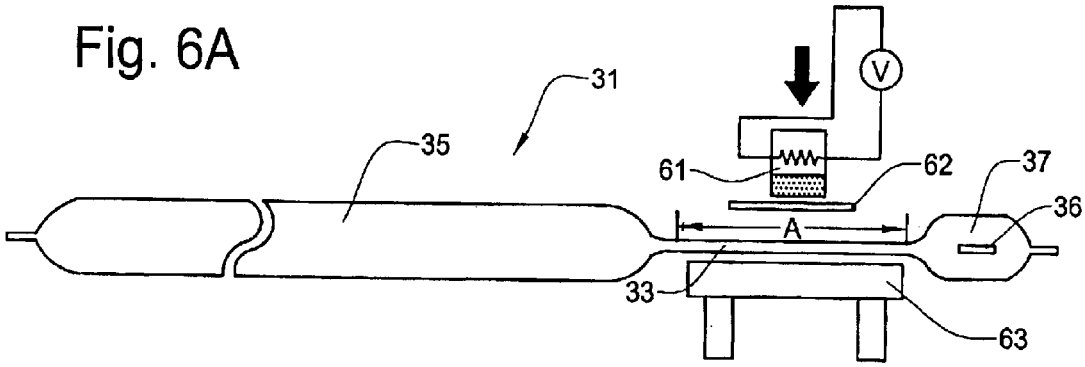
FIGS. 6A–6B are schematic diagrams showing an example of heat sealing the multiple container members of the fluid container in the present invention.
Figure 6B:
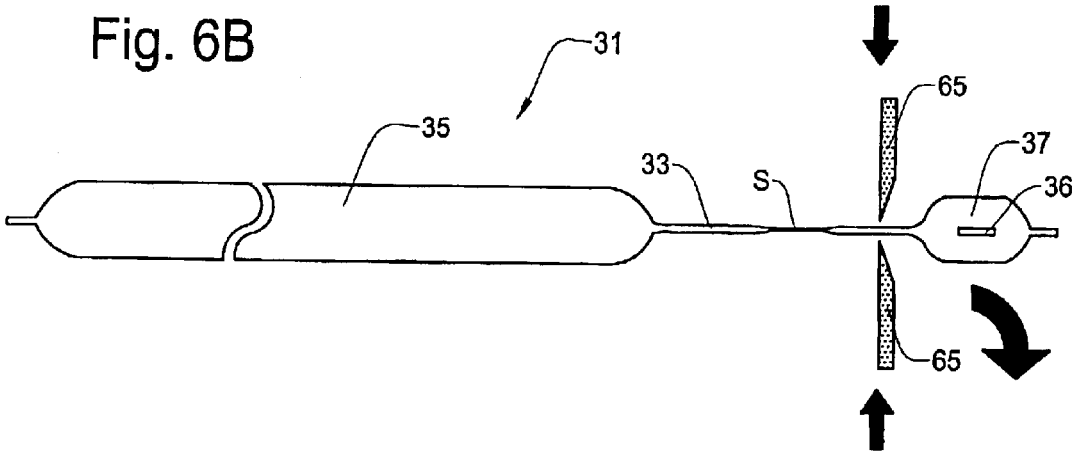

FIGS. 6A–6B show a third preferred embodiment in the present invention. In this example, the fluid container 31 is not reusable because it is permanently sealed. For example, the narrow passages 33 are heat sealed, i.e., through thermal adhesion. Thus, the reverse flows in the narrow passages 33 are prevented by the heat seal.

FIG. 6A is a cross sectional view showing how the heat sealing on the narrow passages 33 is implemented. In this example, after inflating the fluid container 31, the portion of the narrow passages 33 is placed on a bench 63 of a heat press machine. A thermal head 61 of the heat press machine is heated and controlled to keep the head at a predetermined temperature for heat sealing. Preferably, a Teflon sheet 62 is inserted between the thermal head 61 and the surface of the narrow passages 33 to prevent the head 61 from sticking to the fluid container 31.

By pressing the thermal head 61 on the Teflon sheet 62 to provide the heat, the heated portion of the narrow passages 33 of the fluid container 31 is melted so that all of the passages 33 are closed. Accordingly, the reverse flows through the narrow passages 33 are no longer possible. The sealed (melted) portion of the narrow passages 33 is shown by a label S in FIG. 6B.

FIG. 6B also shows how to cut off an unnecessary portion (ex. guide passage 37, check valve 36, etc.) of the fluid container 31 after heat sealing the narrow passages 33. This cutting out operation is performed if the guide tube 37 is not necessary, for example to reduce the overall size of the fluid container 31. Thus, the cutting off process may not be necessary if the size of the fluid container is less important or the guide passage 37 is also used as a cushion for packing. A cutter 65 is used to cut off the portion between the sealed portion S and the guide passage 37 as shown in FIG. 6B.

In all the above embodiments of the present invention, it should be noted that only one check-valve 36 at the inlet port of the fluid container 31 works very effectively for preventing the reverse flow in order to easily perform a later process such as the clamping and/or heat sealing process. In other words, because the check valve can automatically prevents the reverse flow after inflating the fluid container, the later process for preventing the reverse flows from the container elements can be easily performed by using the clamping or heat sealing tool.

As has been in the foregoing, the sealing method and apparatus in the present invention enables a user to quickly inflate the fluid container and easily make each container element independent from one another by clamping or heat-sealing the narrow passages connected to the corresponding container members. If the clamping member is used, the fluid container can be used repeatedly. Further, as a result of reducing the number of check-valves used in the fluid container, the cost for producing the container is substantially reduced. If the heat sealing method is used, the single check valve makes the process easy although the container itself is non-reusable. This feature is also effective in reducing the total production cost of the container.

Although the invention is described herein with reference to the preferred embodiments, one skilled in the art will readily appreciate that various modifications and variations may be made without departing from the spirit and the scope of the present invention. Such modifications and variations are considered to be within the purview and scope of the appended claims and their equivalents.

What is claimed is:

1. A fluid container for sealingly containing a fluid, comprising:

first and second thermoplastic container films juxtaposed with each other where predetermined portions of the first and second thermoplastic container films are bonded, thereby creating a guide passage, a plurality of container members, and narrow passages connecting the guide passage and the container members; and a check-valve formed at an input of the guide passage for allowing a fluid flow of only one predetermined direction;

wherein a fluid is introduced through the input of the guide passage, the check-valve, and the narrow passages to the container members, thereby inflating the container members, and wherein the narrow passages are sealed after the inflation of the container members.

2. A fluid container as defined in claim 1, wherein said narrow passages are sealed by a clamp member having a set of a clamp rod and a receptacle made of flexible material, and wherein said clamp member clamps the narrow passages between the receptacle and the clamp rod by positioning the narrow passages on the receptacle and pressing the clamp rod in the receptacle.

3. A fluid container as defined in claim 2, wherein said clamp rod has an outer diameter which is substantially the same or smaller than an inner diameter of the receptacle, and wherein said receptacle has an opening which is slightly smaller than the outer diameter of the clamp rod, thereby locking said clamp rod when said clamp rod is pressed in the receptacle.

4. A fluid container as defined in claim 2, wherein said narrow passages are folded in two after the inflation, and a folded portion is air-tightly sealed by said clamp member.

5. A fluid container as defined in claim 2, wherein said clamp rod and said receptacle are integrally made of plastic material.

6. A fluid container as defined in claim 1, wherein said narrow passages are sealed by a clamp member having two sets of a clamp rod and a receptacle made of flexible material, and wherein said clamp member clamps the narrow passages between the receptacles and the clamp rods by positioning the narrow passages on the receptacles and pressing the clamp rods in the receptacles.

7. A fluid container as defined in claim 6, wherein in each set of said clamp rod and receptacle, said clamp rod has an outer diameter which is substantially the same or smaller than an inner diameter of the receptacle, and wherein said receptacle has an opening which is slightly smaller than the outer diameter of the corresponding clamp rod, thereby locking said clamp rod when said clamp rod is pressed in the receptacle.

8. A fluid container as defined in claim 6, wherein said clamp member further includes a bulge between the two receptacles, wherein said bulge is protruded in a direction opposite to an inner projection of each receptacle, thereby increasing an sealing effect when the clamp rods are pressed in the corresponding receptacles.

9. A fluid container as defined in claim 1, wherein said narrow passages are sealed by applying heat thereto thereby permanently closing the narrow passages.

10. A fluid container as defined in claim 9, wherein an unwanted portion of said fluid container is cut off after heat sealing the narrow passages.

11. A method of producing a fluid container for sealingly containing a fluid therein, comprising the following steps of:

providing first and second thermoplastic container films juxtaposed with each other;

bonding predetermined portions of the first and second thermoplastic container films, thereby creating a guide passage, a plurality of container members, and narrow passages connecting the guide passage and the container members;

forming a check-valve between the first and second thermoplastic container films at an inlet of the fluid container;

inflating the plurality of container members by introducing a fluid through the guide passage, the check-valve, and the narrow passages to the container members; and air-tightly sealing the narrow passages after the inflation of the container members.

12. A method of producing a fluid container as defined in claim 11, wherein said step of sealing the narrow passages includes a step of sealing them by a clamp member having a set of a clamp rod and a receptacle made of flexible material, and wherein said clamp member clamps the narrow passages between the receptacle and the clamp rod by positioning the narrow passages on the receptacle and pressing the clamp rod in the receptacle.

13. A method of producing a fluid container as defined in claim 12, wherein said clamp rod has an outer diameter which is substantially the same or smaller than an inner diameter of the receptacle, and wherein said receptacle has an opening which is slightly smaller than the outer diameter of the clamp rod, thereby locking said clamp rod when said clamp rod is pressed in the receptacle.

14. A method of producing a fluid container as defined in claim 12, wherein said step of sealing the narrow passages includes a step of folding the narrow passages in two after the inflation, and air-tightly sealing the folded portion of the narrow passages by said clamp member.

15. A method of producing a fluid container as defined in claim 12, wherein said clamp rod and said receptacle are integrally made of plastic material.

16. A method of producing a fluid container as defined in claim 11, wherein said step of sealing the narrow passages includes a step of sealing the narrow passages by a clamp member having two sets of a clamp rod and a receptacle made of flexible material, and wherein said clamp member clamps the narrow passages between the receptacles and the clamp rods by positioning the narrow passages on the receptacles and pressing the clamp rods in the receptacles.

17. A method of producing a fluid container as defined in claim 16, wherein in each set of said clamp rod and receptacle, said clamp rod has an outer diameter which is substantially the same or smaller than an inner diameter of the receptacle, and wherein said receptacle has an opening which is slightly smaller than the outer diameter of the corresponding clamp rod, thereby locking said clamp rod when said clamp rod is pressed in the receptacle.

18. A method of producing a fluid container as defined in claim 16, wherein said clamp member further includes a bulge between the two receptacles, wherein said bulge is protruded in a direction opposite to an inner projection of each receptacle, thereby increasing an sealing effect when the clamp rods are pressed in the corresponding receptacles.

19. A method of producing a fluid container as defined in claim 11, wherein said step of sealing the narrow passages includes a step of sealing the narrow passages by applying heat thereto thereby permanently closing the narrow passages.

20. A method of producing a fluid container as defined in claim 19, further comprising a step of cutting off an unwanted portion of said fluid container after heat sealing the narrow passages.

* * * * *